United States Patent [19]

Whitman

[11] Patent Number: 4,788,807

[45] Date of Patent: Dec. 6, 1988

[54] FASTENING PLATE FOR FACILITATING INSTALLATION OF RUBBER ROOF COVERING

[76] Inventor: Robert E. Whitman, 1-2143 Sherwood Ln., Swanton, Ohio 43558

[21] Appl. No.: 858,020

[22] Filed: May 1, 1986

[51] Int. Cl.[4] ..... E04B 1/38

[52] U.S. Cl. ..... 52/410; 52/512; 411/369; 411/531

[58] Field of Search ..... 52/506, 513, 410, 509, 52/698, 512

[56] References Cited

U.S. PATENT DOCUMENTS

| | | | |
|---|---|---|---|
| 2,007,179 | 7/1935 | Bullis | 411/369 |
| 3,426,412 | 2/1969 | Streng et al. | 24/462 |
| 4,455,804 | 6/1984 | Francovitch | 52/698 |
| 4,528,783 | 7/1985 | Muir | 52/509 |

*Primary Examiner*—James L. Ridgill, Jr.
*Attorney, Agent, or Firm*—George R. Royer

[57] ABSTRACT

The invention herein is directed to a bonding plate used for facilitating the process of affixing rectangularly shaped sheets of rubber roofing material to the upper surface of a roof. The invention related to an integrated bonding plate apparatus serving as a fastening plate and is affixed in a flush manner to the upper rubber roof surface, with fastening means such as nails, screws, or other similar means being used to affix the bonding plate through the rubber roof to the fixed roof structure. The device comprises a flat member having a concentric, centrally located removable insert, which insert has opening means there through to receive one type or size of fastening means, and with the insert removed the bonding plate has another size and type of opening to receive yet another type and size of fastening member.

2 Claims, 1 Drawing Sheet

FASTENING PLATE FOR FACILITATING INSTALLATION OF RUBBER ROOF COVERING

BACKGROUND OF INVENTION AND DESCRIPTION OF PRIOR ART

The invention herein relates to an apparatus for aiding to secure sheets of rubber roofing to the upper surface of a roof. Roofing sheets comprised of rubber material are now used more widely for roof coverings because of their optimal life and durability. The usual approach is to place over the upper roof surface or structure a grid-like pattern of bonding plates, dispersed over the upper roof surface and spaced relative to one another in a regular matrix-like pattern, generally four feet or more apart. The rubber roof sheets are, in turn, adhered in a flush manner to the upper surfaces of such fastening plates, using a suitable adhesive. In other applications the bonding plates are affixed over the top of the rubber roof sheets to hold the rubber roof sheets in a flush manner to the upper roof surface. The usual arrangement in using such fastening plates is a series of evenly-spaced rows and columns of such plates, regularly and symmetrically spaced as seen from an upper elevation view of such roof. Bonding plates function to securely hold the rubber roofing sheets in place.

The present practice, as stated, is to disperse the bonding plates over the upper roof surface, using nails or screws, to adhere the bonding plate to the upper rubber surface. Once the bonding plates are in place, they serve as the medium to which the rubber sleath is affixed by some appropriate fastening means to affix the bonding plates to the upper roof surface. If the plates are affixed over the rubber sheets, the same arrangement is still used.

One of the predominant problems with the bonding plate fastening process is that if plastic scres are used as opposed to nails, a different size central opening is required in the center of the bonding plate, because when plastic screws are used, 2 larger shank diameter is usually required then the shank diameters of nails, and therefore different size holes are needed in the bonding plate. This invention is therefore directed to this end and the following objects are directed accordingly.

In view of the above, it is an object of the subject invention to provide an improved apparatus for affixing rubber roofing sheets to the upper surface of a roof;

Yet another object of the subject invention is to provide an improved bonding device for installing rubber roof sheets for covering roof structures;

A further object of the subject invention is to provide an improved bonding apparatus for affixing roofing materials to a roof structure.

Still another object of the subject invention is to provide an improved process for adhering and affixing rubber roof sheets to the upper surface of a roof;

Other and further objects will become apparent from a reading of the following description taken in conjunction with the claims.

DESCRIPTION OF GENERAL EMBODIMENT

The subject invention relates to the use of bonding plates used for adhering a number of rectangularly shaped rubber roofing sheets to the upper surface of a roof. In the general embodiment of the subject invention, these bonding plates are flat members that have a centrally located depression on the upper surface. The depression has in its center area an opening which extends completely through to the lower surface of such bonding plate. This opening is adapted to receive the longitudinal shank of a plastic screw, usually of wide girth. The depression in the upper surface of the bonding plate is adapted to receive a congruently fitted insert that has a center hole of a smaller diameter for nails.

DESCRIPTION OF PREFERRED EMBODIMENT

The subject invention centers on a physical apparatus for affixing rubber roof sheets to the upper surface of a roof of any type of building structure. However, the preferred embodiment of the subject invention is most applicable to roof structures wherein the roof is horizontal, although it is not to be so limited. While the description below is explicitly directed to an application wherein the bonding plates are affixed over top of the rubber roof sheets, it will be understood that this invention is equally applicable to those circumstances where the bonding plates are affixed between the upper roof surface and the lower surface of the rubber roofing sheets. Moreover, descrption and application of the preferred embodiment is not to be considered as limiting the scope of the subject invention.

Figure 1:
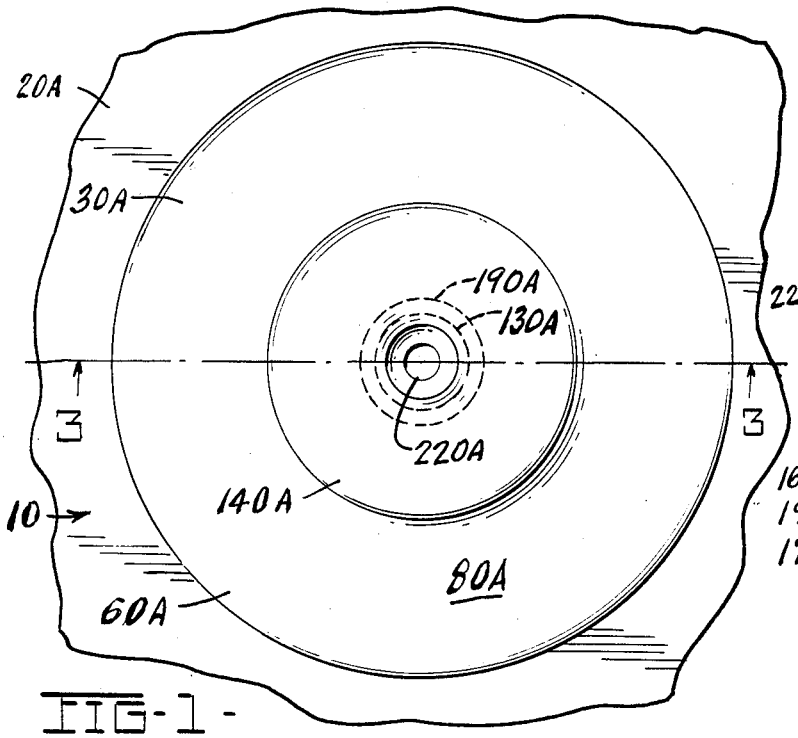
FIG. 1 is a top planar view of the bonding plate arrangement utilizing the invention herein.
Figure 2:
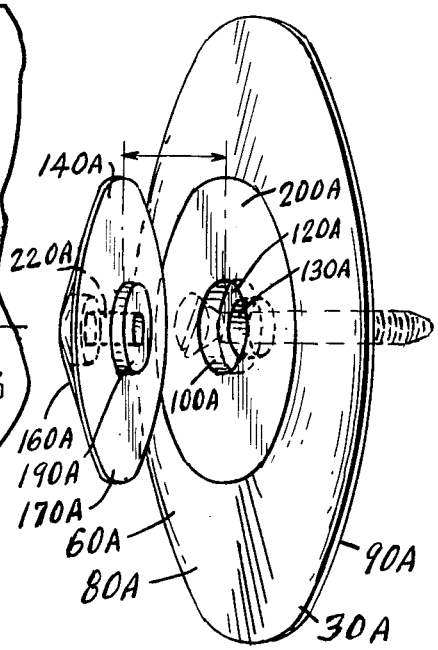
FIG. 2 is a side elevational view of the subject device shown with the central insert being removed.
Figure 5:
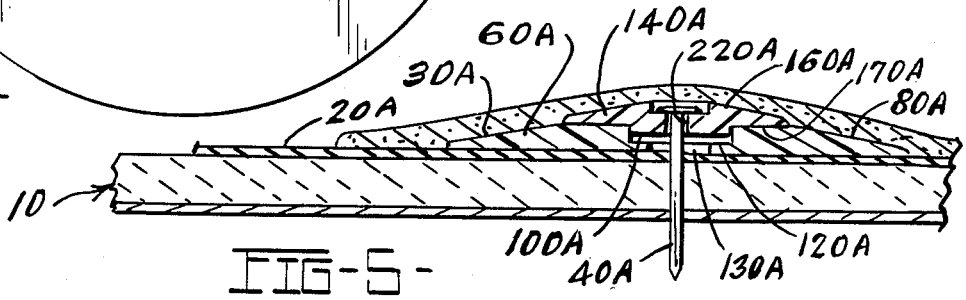
FIG. 5 is a side elevational view of the subject device.

Turning now to the drawing, the subject invention involves an apparatus and method to aid in the affixing of rubber roof sheets to a roof surface such as roof 10 shown in FIGS. 1 and 5. In this respect, the roof 10 is a horizontal, flat roof having perimeter edges not shown. Such roof is considered conventional in this regard, however, the subject invention can apply to a roof of any external configuration, whether rectangular, flat or other structural shape.

In the process of affixing rubber roof sheets to roof 10, the first step in the process is to lay, in a flush manner, a plurality of rectangular shaped rubber roof sheets, such as sheet 20A, shown in FIG. 5, to the upper surface of the roof 10. The roofing sheet 20A is affixed in a regular grid-like pattern so that all such sheets cover the entire roof surface in a flush manner. Next, a bonding plate such as bonding plate 30 is affixed over the upper surface of the rubber roof sheets, as shown in FIG. 5 once laid in the manner described above, and the bonding plates are generally affixed in a series of evenly-spaced rows and columns, in a similar grid pattern, although this feature is not critical to the subject invention. The subsequent step is to nail, screw, spike or affix by a suitable fastening member 40A through the center hole in the bonding plate 30A so as to affix such bonding plate through the rubber roofing sheet to the roof 10, as seen in FIG. 5. Certain applications are better suited for screws as opposed to nails on other means as the fastening device, and an adaptable bonding plate is necessary for the varying size of shanks used for plastic screws, for instance as opposed to nails.

The bonding plates 30A incorporating the subject invention are employed by placing them over the upper surface of the rubber roof sheet 20A after the rubber roof is emplaced over the roof surface 10. By being so placed over the top of the rubber roof sheet 20A, the bonding plate 30A, covers only a portion of the rubber roof sheet, as shown in FIG. 5. Once so emplaced over the top of the rubber roof sheet 20A, the bonding plate 30A is fastened to the roof 10 by a fastening member that pierces through the rubber roof sheet 20A, as shown in FIG. 5. In this latter regard, the fastening member is usually a nail, spike, screw, or other similar longitudinally extending member that extends through the bonding plate through the rubber roof sheet. Often plastic screws are used for this purpose and generally the plastic screw members have a large diameter than the nail or other fastening members used.

As shown, the bonding plate 30A is constructed and comprised in part of a plate base member 60A, preferably of circular shape and of plastic composition, however the plate may be other than circular shape and may be other than plastic in composition. As seen in the drawings, the base plate member has an upper surface 80A and a lower surface 90A. The lower surface 90A is basically flat and even over its entire surface, as seen in the drawings. The upper surface 80A has a truncated conical configuration and raises or extends away from the lower surface 90A in a saucer-like manner, as seen in FIG. 3.

Formed into the upper surface of the base plate member 60A member is a circular, indented depression 100A, which extends from the upper surface 80A downwardly through the base plate member 60A to a distance short of the lower surface 90A. This depression 100A can be other than circular, however, the lower surface 120A of the depression 100A is generally flat, with a circular opening 130A in the middle thereof that extends completely through the bonding plate member to the lower surfact 90A. The circular opening 130A is adapted to receive there through a large diameter shank of a screw, such as a plastic screw. Thus a plastic screw or other large diameter fastening device can be inserted through shed opening 30A.

Figure 3:
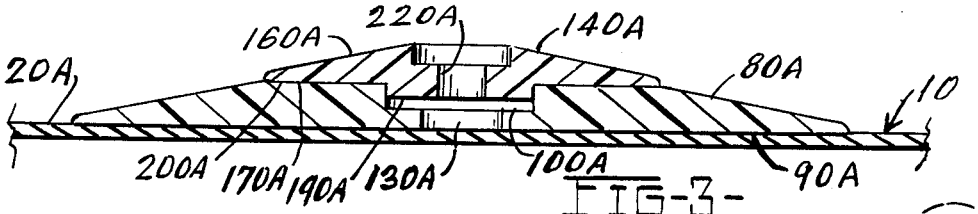
FIG. 3 is a side elevational view of the device incorporating the subject invention.
Figure 4:
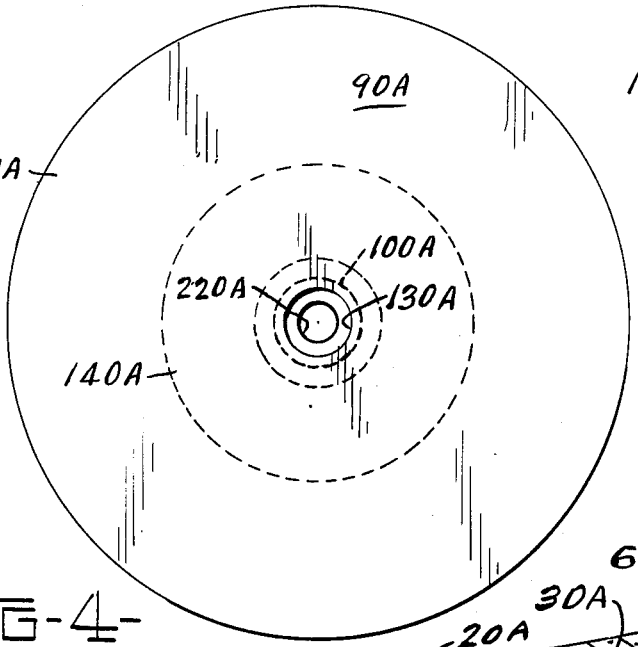
FIG. 4 is a bottom elevational view of the subject device.
Figure 6:
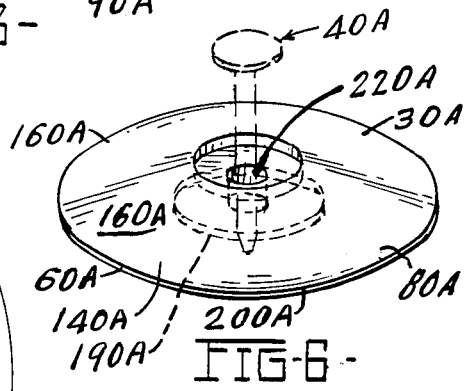
FIG. 6 is a perspective view of the subject device showing the fastening arrangement used therewith.

A circular cap-like member 140A is adapted to be inserted into the circular depression 100A to conformingly fill and cover said depression, as seen in FIG. 3. If the depression 100A is other than circular, the cap 140A will be shaped accordingly so that it fits conformingly into said depression. As seen in the drawings, the cap has an upper surface 160A and a lower surface 170A, with the upper surface having a truncated conical shape, while the lower surface is formed of two flat levels. Specifically, the lower level 190A is circular in configuration while the upper level 200A is also circular in shape, with both such levels being Concentric to one another relative to the center of such cap. The lower level is 150A has a diameter just slightly smaller than the diameter of the depression 100A so that it can fit conformingly therein, and likes the cap 140A is inserted in the depression 100A, the upper surface 160A of the cap is aligned with the scope of the upper surface 80A of the bonding plate 30A, so that the two surfaces are not uneven. Cap 140A has an opening 220A therein that extends all the way through its extent, and such opening 220A is adapted to receive a smaller diameter fastening member, such as a nail, as opposed to the opening 30A. Thus the bonding plate 30A can be affixed to the upper roof surface either through a nail inserted through opening 220A in cap 140A, one cap 140A is inserted in depression 100A, then through opening 130A. Alternately a large diameter plastic screen can be inserted through opening 130A in depression 100A and once inserted the cap is placed on top of the screw head, as shown.

Other embodiments of the subject invention may be employed and the following claims are not to be limited by the foregoing description.

I claim:

1. An apparatus facilitating the affixing of rubber roofing sheets to the upper surface of a bonding plate on a roof surface comprising:

(a) a bonding plate member in the form of a truncated cap member having an upper surface and a lower surface, said base bonding plate member having a circular opening extending from the upper surface to the lower surface, and wherein said base bonding plate member has a circular depression that extends downwardly from the upper surface of said base bonding plate member, and wherein said circular depression is concentric to the circular opening in said base bonding plate member, and wherein said circular depression is larger in diameter than the diameter of said circular opening;

(b) a caplike member shaped in the form of a truncated cap member having an upper portion and a bottom portion which bottom portion has a circular protrusion on the bottom portion thereof which protrusion fits conformingly into the circular depression in the upper surface of said bonding plate member so as to join the caplike member conformingly to said bonding plate and wherein said caplike member has an opening therein which extends completely through said caplike member from the upper surface thereof to the lower surface thereof, and wherein said opening in said caplike member is concentric to said circular protrusion, said opening in said caplike member receiving a longitudinally extending fastening device which extends completely through the opening in said caplike member and the opening in the bonding plate member securing said base bonding plate member and the caplike member together as a unit and also securing said caplike member and bonding plate to the rubber roof sheet and as a unit to the upper surface of a roof surface, securing thereby the rubber roof sheet to the roof surface, and wherein said caplike member has a circular depression in the upper surface thereof which depression is concentric to the circular opening in said caplike member, and which depression is adapted to conformingly receive the head of a longitudinally extending fastening device;

(c) longitudinally extending fastening means adapted to fit longitudinally through the opening in said bonding plate member and the opening in said caplike member and to pierce the rubber roof sheet beneath the bonding plate members to secure said bonding plate member and caplike member to the rubber roof sheet and roof surface.

2. An apparatus for facilitating the affixing of rubber roofing sheets to the upper surface of a bonding plate on a roof surface comprising:

(a) a bonding plate member shaped in the form of a truncated cap member having an upper surface and a lower surface, said base bonding plate member having a circular opening extending from the upper surface to the lower surface, and wherein said base bonding plate member has a circular depression that extends downwardly from the upper surface of said base bonding plate member, and wherein said circular depression is concentric to the circular opening in said base bonding plate member, and wherein said circular depression is larger than the diameter of said circular opening, and wherein said upper surface has a circular flat portion, which is concentric to the center of the circular opening in said bonding plate member;

(b) a caplike member shaped in the form of a truncated cap member having an upper portion and a bottom portion, which bottom portion is adapted to fit concentrically and conformingly to the flat portion on the upper surface of bonding plate member, said cap member having an upper surface and a lower surface, said caplike member having a circular protrusion on the bottom portion thereof which is adapted to fit conformingly into the circular depression in the upper surface of said bonding plate member so as to join the caplike member conformingly to said bonding plate and wherein said caplike member has an opening therein which extends completely through said caplike member from the upper surface thereof to the lower surface thereof, and wherein said opening in said caplike member is concentric to said circular protrusion, said opening being adapted to receive a longitudinally extending fastening device which extends completely through said caplike member and the bonding plate member to secure said base bonding plate member and the caplike member together as a unit and also secure said caplike member and bonding plate and through the rubber roof sheet to the roof surface as a unit to the upper surface of a roof surface securing thereby the rubber roof sheet to the roof surface, and wherein said caplike member has a circular depression in the upper surface thereof which depression is concentric to the circular opening in said caplike member, and which depression is adapted to conformingly receive the head of a fastening device.

* * * * *